US012747869B2

(12) United States Patent
Canestrari et al.

(10) Patent No.: US 12,747,869 B2
(45) Date of Patent: Sep. 29, 2026

(54) STORAGE WATER HEATER EQUIPPED WITH AT LEAST ONE AUXILIARY HEATER AND A CIRCULATOR

(71) Applicant: ARISTON S.p.A., Fabriano (IT)

(72) Inventors: Paolo Canestrari, Fabriano (IT); Lorenzo Ceccacci, Falconara Marittima (IT); Alessandro Conti, Fabriano (IT); Luca D'Andrea, Fabriano (IT); Lorenzo Marra, Osimo (IT)

( * ) Notice: Subject to any disclaimer, the term of this patent is extended or adjusted under 35 U.S.C. 154(b) by 386 days.

(21) Appl. No.: 18/520,923

(22) Filed: Nov. 28, 2023

(65) Prior Publication Data

US 2024/0183541 A1 Jun. 6, 2024

(30) Foreign Application Priority Data

Dec. 6, 2022 (IT) ..... 102022000025023

(51) Int. Cl.
*F24D 17/00* (2022.01)
*F24D 19/10* (2006.01)

(52) U.S. Cl.
CPC ..... *F24D 17/0063* (2013.01); *F24D 17/0078* (2013.01); *F24D 19/1051* (2013.01); *F24D 2220/042* (2013.01); *F24D 2220/044* (2013.01)

(58) Field of Classification Search
CPC ..... F24H 7/00; F24H 15/156; F24H 15/414; F24H 9/20; F24H 9/2021; G05D 23/19; G06Q 50/06
See application file for complete search history.

(56) References Cited

U.S. PATENT DOCUMENTS

| | | | | |
|---|---|---|---|---|
| 10,066,841 | B2 * | 9/2018 | Ng | F24S 90/00 |
| 11,359,823 | B2 * | 6/2022 | Zhang | F24H 15/219 |

FOREIGN PATENT DOCUMENTS

| | | | | |
|---|---|---|---|---|
| DE | 102010034008 | A1 | 2/2012 | |
| EP | 2453334 | A1 | 5/2012 | |
| EP | 3470744 | A1 | 4/2019 | |
| JP | 2001317806 | A | 11/2001 | |
| WO | 2006111755 | A2 | 10/2006 | |
| WO | WO-2021204794 | A1 * | 10/2021 | F24D 3/08 |
| WO | 2022168050 | A1 | 8/2022 | |

OTHER PUBLICATIONS

Search Report for Priority Italian Application No. 102022000025023, dated Jun. 5, 2023 [Note English description of relevance of documents cited on pp. 7-9 of the Search Report].

* cited by examiner

*Primary Examiner* — Gregory A Wilson
(74) *Attorney, Agent, or Firm* — Egbert, McDaniel & Swartz, PLLC

(57) ABSTRACT

A storage water heater includes at least one heating device, at least one storage tank wherein water is stored and heated, at least one control and management unit capable of checking at least the heating device, at least one inlet duct through which water may be introduced into the tank, at least one outlet duct through which water may be sent/withdrawn from the tank, wherein there are at least two heating devices, of which at least one main heating device and at least one auxiliary heating device are provided, and wherein the water heater includes a circulator dedicated, via at least one hydraulic connection duct, to the recirculation of the storage water stored in the tank, the circulator being capable of recirculating the water of the storage between the lower part and the top part of the tank, by passing through the auxiliary heating device.

21 Claims, 6 Drawing Sheets

STORAGE WATER HEATER EQUIPPED WITH AT LEAST ONE AUXILIARY HEATER AND A CIRCULATOR

FIELD OF THE INVENTION

The object of the present invention is a storage water heater or the like, preferably used for the production of domestic hot water.

More in detail, the present invention refers to a storage water heater provided with at least a main heater and at least an additional/auxiliary heater.

Even more in detail, the present invention refers to a storage water heater heated by at least a main heater and provided with at least a first and/or a second additional/auxiliary heater.

A further object of the present invention is a management method of a storage water heater and of the heating elements thereof.

BACKGROUND OF THE INVENTION

Storage water heaters are currently known equipped with a main heater and with an additional heater arranged within the storage tank of the water to be heated.

Generally, said additional heater comprises one or more electric resistances which, by conduction, heat the water wherein they are immersed.

Such type of water heater presents different drawbacks.

The main one is linked to the fact that the contact with water causes the electrical resistance to have a gradual deterioration and loss of efficiency due to the formation of limescale or the like.

During the use, therefore, the electrical resistance requires maintenance or a replacement thereof, increasing the management costs of the same water heater.

Another problem of the current water heaters concerns the overall dimensions and sizes thereof strictly related to the shape and capacity (volume) of the tank, but also to the overall dimensions of the heating elements provided by the same water heater.

Currently, compact and small overall dimension water heaters are preferred and such preference is not always met by the water heaters offered on the market.

This is due to the type of heating elements provided by the water heater.

For example, heat pumps, which are finding more and more application in the sector of the storage water heaters, have significant overall dimensions due to the presence of heat exchangers (evaporator/condenser) which, in order to carry out their function, require certain heat exchange surfaces and the presence of essential components, such as, for example, compressors or others.

The currently available water heaters, therefore, do not fully meet the needs of the market which requires small overall dimensions and low management/maintenance costs.

BRIEF SUMMARY OF THE INVENTION

The object of the present invention is to obviate such kind of drawbacks by providing for a storage water heater or the like, preferably for the production of domestic hot water, able to keep low the overall dimensions.

A further object of the present invention, at least for one or more executive variants, is to provide a storage water heater or the like provided with at least a main heater and at least a additional/auxiliary heater.

A further object of the present invention, at least for one or more executive variants, is to provide a management method of a storage water heater and of the heating elements thereof.

This and other objects, which shall appear clear hereinafter, are achieved with a storage water heater or the like and relative management method, according to claim 1.

Other objects may also be achieved by means of the additional features of the dependent claims.

BRIEF DESCRIPTION OF THE SEVERAL VIEWS OF THE DRAWINGS

Further features of the present invention shall be better highlighted by the following description of a preferred embodiment, according with the patent claims and illustrated, purely by way of a non-limiting example, in the accompanying drawing tables, in which:

Figure 3:
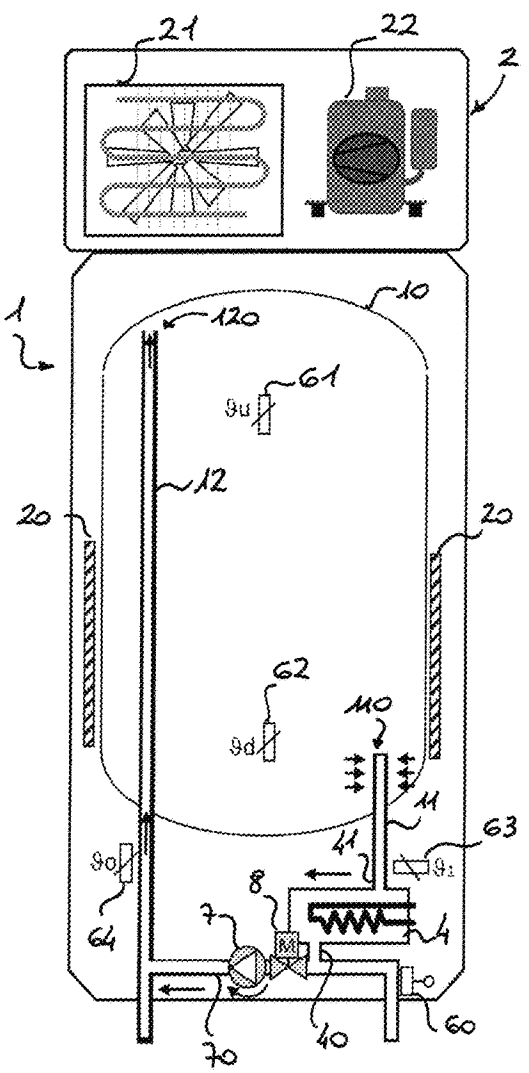
FIG. 3 shows the path of the water within the water heater of FIG. 1 during a recirculation and heating operation of the storage water.

The features of a storage water heater or the like according to the present invention and of the relative management method are now described using the references contained in the figures.

DETAILED DESCRIPTION OF THE INVENTION

The parameters and functions/conditions and the respective references used hereinafter in the description are listed below:

ϑu: storage water temperature in the proximity of the top zone of the tank, substantially that adjacent to the upper cap (or dome) of the same tank;

ϑd: storage water temperature in the proximity of the lower zone of the tank, substantially that adjacent to the lower cap of the same tank;

ϑo: "temperature out", i.e. the temperature of the water at the outlet of the tank of the water heater;

ϑ1: "temperature in", i.e. the temperature of the make-up water of the storage, generally withdrawn from the water network, following a withdrawal;

ϑ2: "temperature heat", optional parameter identifying the temperature of the water at the outlet of the post-heater, when provided, of the water heater; ϑ2 allows monitoring the value of the temperature of the water supplied by the water heater by checking whether it meets or not the comfort temperature Tc;

Tm: the average temperature of the water of the storage and may be calculated as: Tm=a*ϑu+b*ϑd, where "a" and "b" are percentage values that act as weights in order to carry out a weighted average and may depend on, for example, on the capacity of the tank and/or entity of the withdrawal (or tapping) and/or on the reactivity and readiness degree that it is desired to be given to the water heater;

Tc: comfort temperature, temperature that may be set by the manufacturer and/or installer and/or user below which the water of the storage may not be supplied;

Tset: set point temperature, temperature at which the storage may be heated/maintained and may be set by the manufacturer and/or installer and/or user;

X: is a hysteresis value and may be used to avoid frequent and subsequent re-ignitions of the main heating device; it is generally set by the manufacturer and/or installer based on the type of water heater and/or on the type and shape of the plant or the like and may vary between 3÷12, preferably between 5-8 (dimensionless quantity);

BOOST: additional function of the water heater which allows an additional heating, compared to that provided via the main heating device, of the inlet water and/or of the storage of the water heater via at least a of the auxiliary heating devices provided by the said water heater; the BOOST function may be set by default and therefore always implemented by the water heater, or a function that may be selected at discretion by the user or by the installer as needed (therefore, it may be voluntarily deactivated if not desired);

FL: represents a reference value for the amount of make-up water flow so as to be able to determine whether the withdrawal in progress is a small withdrawal or a large withdrawal. The withdrawal methods are preferably referred to the standard EN 16147 which describes the product performance test procedure, and defines the type of withdrawal based on the energy content of the water withdrawn from the storage tank; for example, a withdrawal is defined as small when it has an energy content lower than 1.4 kWh;

COLD TANK: additional function of the water heater that allows for an additional heating if a "cold tank" condition has occurred, i.e. if the temperature of the storage water has dropped below a threshold value. Such condition is true if Tm<Tsv, where Tsv represents a threshold temperature value set by the manufacturer and/or installer and/or user, or, if the water heater implements SMART logics, in view of a future withdrawal (SMART logics are to be understood as learning methods of the user usual consumption of hot water, as well as of the management methods of the water aimed at heating the water via a generic storage water heater that may be governed through an electronic control so that water is heated only in the quantity and at the times provided based on said expected usual consumption).

It should be noted that the arrows shown in the accompanying figures essentially indicate the path of the water entering and exiting the water heater according to the present invention.

The term storage water heater is herein to be understood as any device capable of heating water in a storage tank, in particular domestic hot water for hygienic uses, until reaching a certain temperature herein defined as set-point temperature T.set.

As clearly shown in the accompanying figures, 1 indicates, as a whole, the storage water heater 1 according to the present invention, hereinafter referred to as only water heater 1, for clarity of description.

Generally, said water heater 1 may comprise at least a heating device, at least a storage tank 10 wherein water is stored and heated, at least a control and management unit capable of controlling said at least a heating device, at least an inlet duct 11 through which water may be introduced into the tank 10, at least an outlet duct 12 through which water may be sent/withdrawn from the tank 10, said inlet ducts 11 and 12 being in fluid communication with said tank 10.

The heating device may be of the electric type, i.e. comprising at least a electric device, such as for example electric resistances or the like, or of the heat pump, solar energy, or gas, geothermal type or the like, or possible combinations thereof.

Generally, in a storage water heater the water inside the storage tank has a stratification according to the temperature, said stratification being due to the heating process caused by the heating elements and by the density of the water.

In fact, the hottest water tends to migrate and settle in the top part of the tank, while the colder water tends to settle in the lower part of the same tank.

According to a preferred variant, the outlet section 110 of the inlet duct 11 is preferably positioned in the proximity of the lower zone of the said tank 10, while the inlet section 120 of the outlet duct 12 is preferably positioned in the proximity of the median or, even more preferably, top zone of the said tank 10.

During the operation of the water heater 1, such arrangement determines a water make-up, generally from the water network, in the lower area of the tank 10 and a withdrawal of hot water in the upper zone thereof, thus keeping the stratification of the water based on the temperature thereof and essentially guaranteeing the withdrawal and supply of hot water.

According to a preferred variant, said water heater 1 comprises at least two heating devices, of which preferably at least a main one and at least an auxiliary one.

Generally, "main" heating device refers to as a device which is designed to heat water in normal/standard conditions, while "auxiliary" is to be understood as a device designed to heat water in particular conditions, for example when it is preferred to have a heat source in addition to the main one.

The following may be identified of said at least two heating devices:

at least a first heating device, herein identified as "main", which may comprise a heat pump or means using the solar or geothermal energy or the like; and at least a second heating device, herein identified as "auxiliary", which may comprise heaters, preferably of the instantaneous type, comprising, for example, electric resistances or the like.

Preferably, according to a possible executive variant, shown in the accompanying figures by way of a non-limiting example:

said at least a first main heating device comprises a heat pump 2 provided with at least a compressor 22, a evaporator 21, a lamination member and a condenser 20 suitably arranged so as to heat the water of the storage, for example, according to a possible executive variant, said condenser 20 may be arranged in contact with/around the walls of the tank 10 so as to be able to cooperate therewith, at least thermally, and heat the water contained in the same tank 10;

said at least a second auxiliary heating device comprises at least a electric heater and, for the purposes of the invention, may be arranged externally to the storage tank 10.

Figure 2:
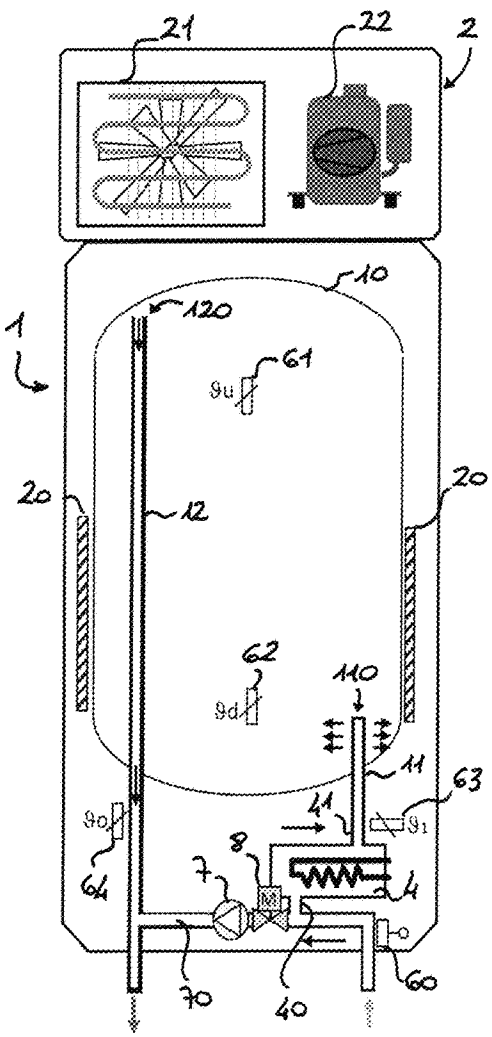
FIG. 2 shows the path of the water during a hot water withdrawal from the water heater of FIG. 1.
Figure 1:
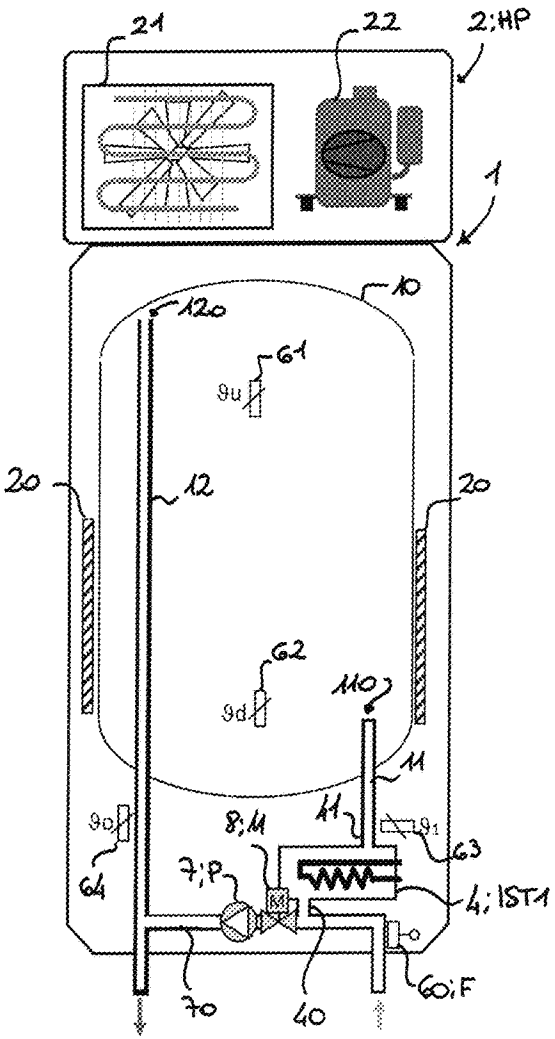
FIG. 1 shows a schematic section view of the water heater of the present invention according to a first possible executive variant, where said water heater is equipped with at least a auxiliary heating device which acts as a pre-heater.
Figure 7:
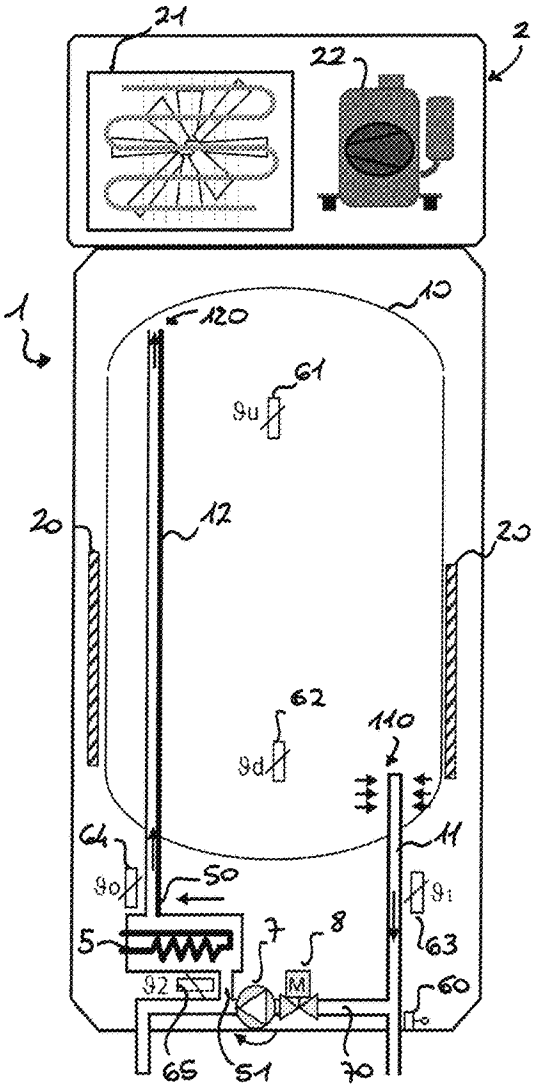
FIG. 7 shows the path of the water within the water heater of FIG. 5 during a recirculation and heating operation of the storage water.
Figure 6:
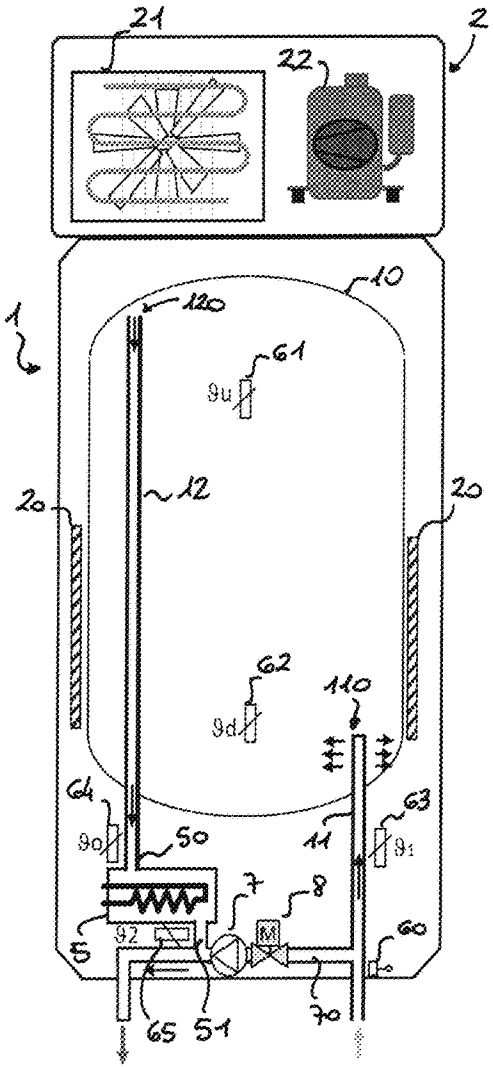
FIG. 6 shows the path of the water during a hot water withdrawal from the water heater of FIG. 5.
Figure 5:
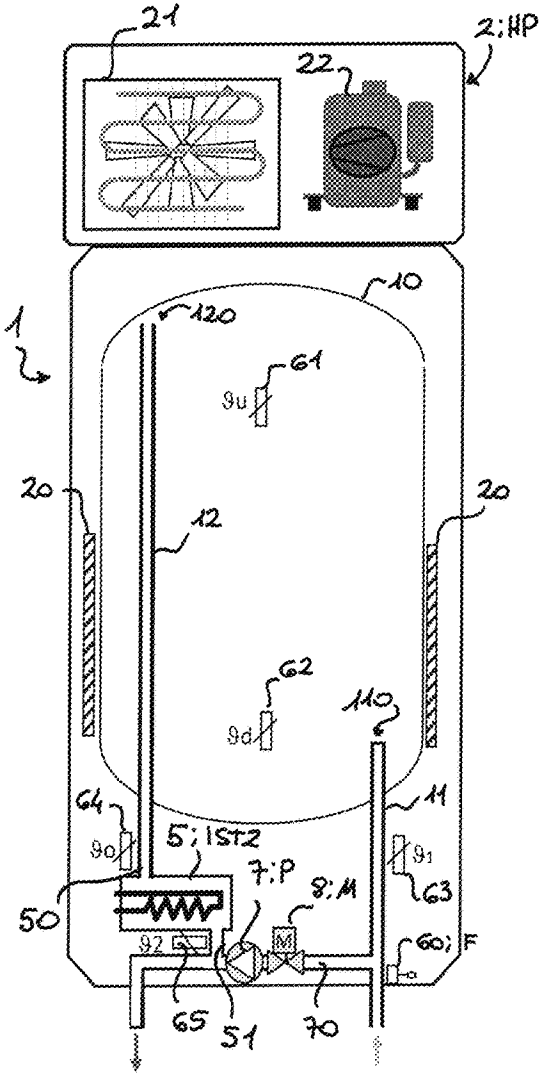
FIG. 5 shows a schematic section view of the water heater of the present invention according to a second possible executive variant, where said water heater is equipped with at least a auxiliary heating device which acts as a post-heater.

According to different possible executive variants, said second device may be preferably installed:

along the inlet duct 11 so as to be able to act as a pre-heater 4, an executive variant illustrated in the FIGS. 1-3, so as to be able to heat the make-up water entering the tank 10; or along the outlet duct 12 so as to be able to act as a post-heater 5, an executive variant illustrated in the FIGS. 5-7, so as to be able to heat the supplied water exiting the tank 10.

Figure 11:
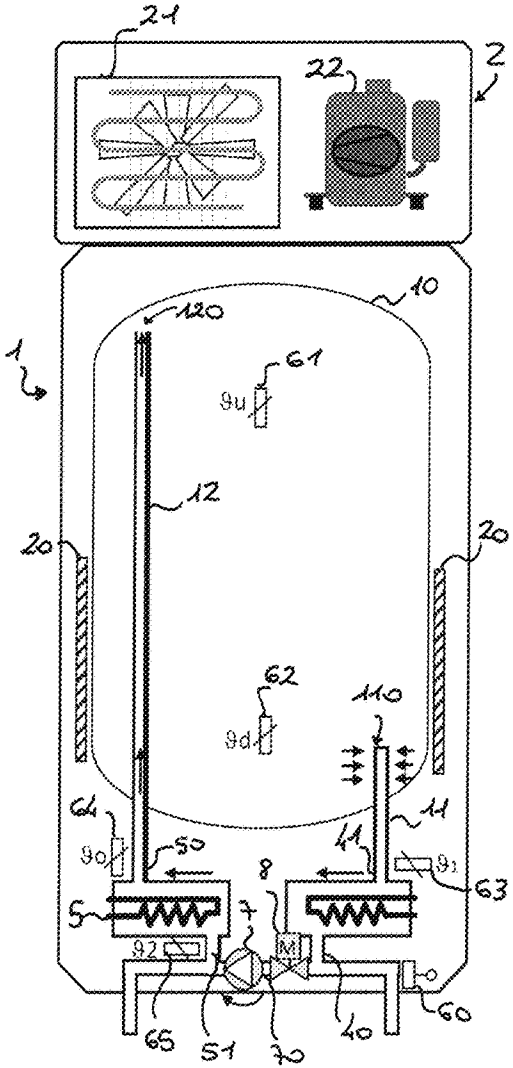
FIG. 11 shows the path of the water within the water heater of FIG. 9 during a recirculation and heating operation of the storage water.
Figure 10:
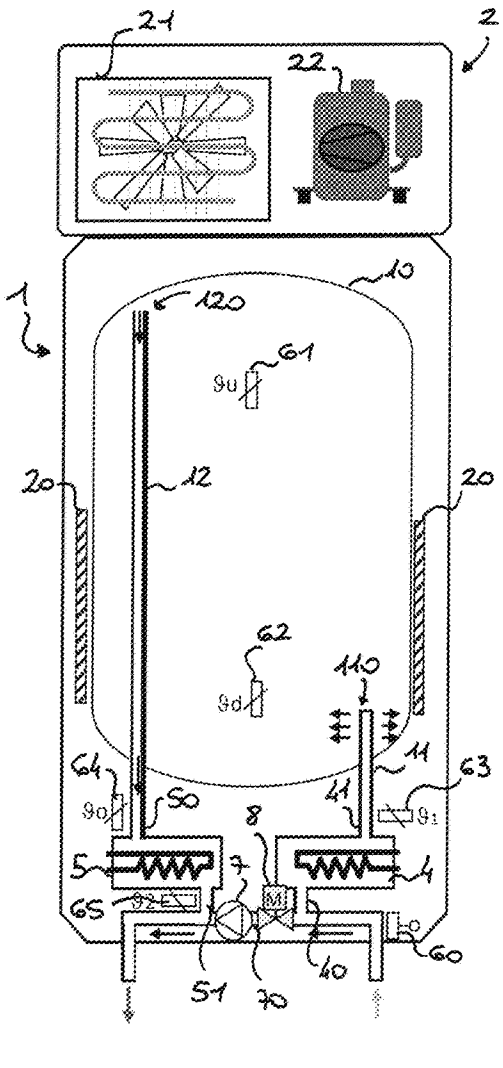
FIG. 10 shows the path of the water during a hot water withdrawal from the water heater of FIG. 9.
Figure 9:
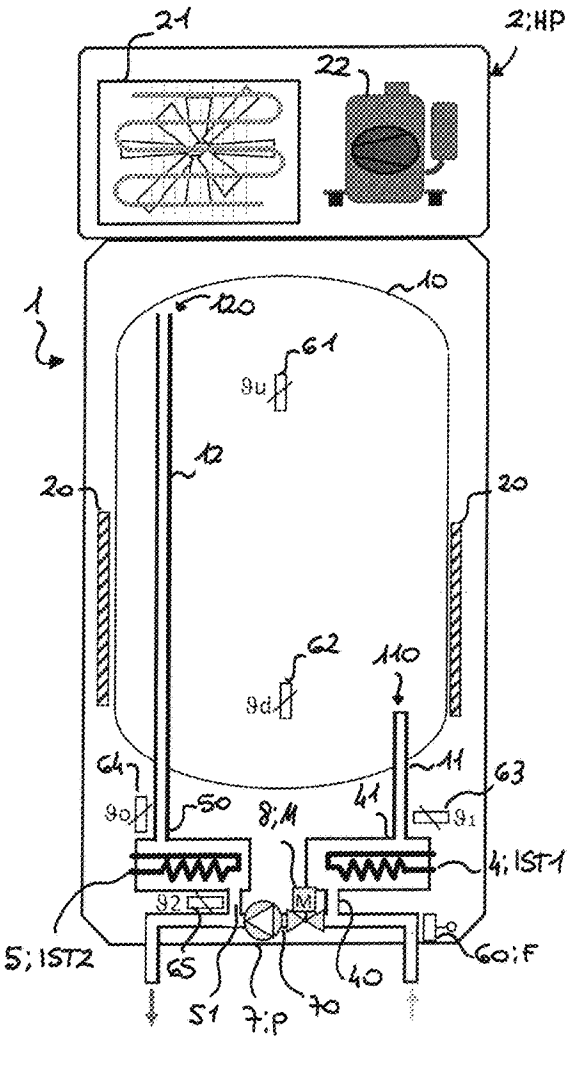
FIG. 9 shows a schematic section view of the water heater of the present invention according to a third possible executive variant, where said water heater is equipped with at least a auxiliary heating device which acts as a pre-heater and with at least a auxiliary heating device which acts as a post-heater.

According to a possible embodiment variant, provided by way of a non-limiting example, nothing prevents said water heater 1 from simultaneously comprising and integrating at least a pre-heater 4 and at least a post-heater 5 (FIGS. 9-11).

In such case the water heater 1 comprises a further auxiliary device that may be installed, according to the possible executive variants, along the inlet duct 11 or along the outlet duct 12.

According to such possible variant, therefore, the water heater 1 provides for at least three heating devices of which at least a main device and at least two auxiliary devices respectively installed one along the inlet duct 11 and the other along the outlet duct 12.

Generally, it is possible to use an auxiliary device, both when it acts as a pre-heater 4 and when it acts as a post-heater 5, which may be equipped with power regulation means which allow the energy supply provided by the said device to be managed in relation to the comparison between the energy contents: of the storage water and of the recirculation water and/or of the storage water and of the make-up water and/or of the storage water and of the water supplied by the water heater 1.

According to a preferred variant, said pre-heater 4 is installed upstream of the outlet section 110 of the inlet duct 11, while said post-heater 5 is installed downstream of the inlet section 120 of the outlet duct 12.

The arrangement of said pre-heater 4 and post-heater 5 may be maintained even if the water heater 1 provides only for one of said auxiliary devices.

The arrangement of said pre-heater 4 and post-heater 5, which are preferably external to the tank 10, allows for a convenient inspection and possible easy replacement thereof.

The water heater 1 may further comprise:

at least a first temperature sensor 61 arranged in the proximity of the top zone of the tank 10 and capable of detecting the temperature 9*u* of the storage water; and/or at least a second temperature sensor 62 arranged in the proximity of the lower zone of the tank 10 and capable of detecting the temperature 9*d* of the storage water; and/or at least a third temperature sensor 63 arranged in the proximity/along the inlet duct 11 of the tank 10, preferably downstream of the outlet section 41 of the pre-heater 4 when provided, and capable of detecting at least the temperature 91; and/or at least a fourth temperature sensor 64 arranged in the proximity/along the outlet duct 12 of the tank 10, preferably upstream of the inlet section 50 of the post-heater 5 when provided, and capable of detecting at least the temperature 90; and/or at least a fifth temperature sensor 65 arranged in the proximity/along the outlet duct 12 of the tank 10, preferably downstream of the outlet section 51 of the post-heater 5 when provided, and capable of detecting at least the temperature 92; and/or at least a flow sensor 60 capable of detecting the water flow entering or exiting the tank 10, i.e. the water flow crossing the inlet duct 11 or the outlet duct 12.

Preferably, said sensors are suitably connected and communicating with said control unit.

Generally, said flow sensor 60 may be installed along the inlet duct 11.

Nothing prevents said flow sensor 60 from being installed along the outlet duct 12, as the general object of the flow sensor 60 is to detect whether or not a water withdrawal/make up from/into the tank 10 is in progress.

Generally, by comparing the flow value F detected by the sensor 60 with the reference value FL, the withdrawal in progress may be evaluated and classified as small or large.

The water heater 1 is characterised in that it comprises at least a circulation pump or circulator 7, hereinafter referred to as circulator 7 for descriptive convenience, and at least a specific hydraulic connection duct 70.

Preferably, said circulator 7 is dedicated to the recirculation of the storage water stored in the tank 10 according to methods described shortly.

Even more preferably, said circulator 7, through said at least a hydraulic connection duct 70, is capable of recirculating the storage water between the lower part and the top part of the tank 10 passing through the at least an auxiliary heating device.

Said hydraulic duct 70 puts the circulator 7 into fluid communication with said at least an auxiliary heating device and said lower and top parts of the tank 10.

For example, based on the fact that the water heater 1 provides for at least an auxiliary device that acts as a pre-heater 4 or as a post-heater 5 or provides for both, said circulator 7 is capable of recirculating the water between:

the lower part of the tank 10, the pre-heater 4 and the top part of the said tank 10 (FIG. 3); or the lower part of the tank 10, the post-heater 5 and the top part of the said tank 10 (FIG. 7); or the lower part of the tank 10, the pre-heater 4, the post-heater 5, and the top part of the said tank 10 (FIG. 11); said circulator being in fluid communication with said pre-heater 4 and post-heater 5 through said hydraulic connection duct 70.

Generally, therefore, said circulator 7 may be in fluid communication via said hydraulic duct 70, substantially:

- with the inlet 40 of the said pre-heater 4 and the outlet duct 12 (FIGS. 1-3); or
- with the outlet 51 of the said post-heater 5 and the inlet duct 11 (FIGS. 5-7); or
- both with the inlet 40 of the said pre-heater 4 and with the outlet 51 of the said post-heater 5 (FIGS. 9-11).

Generally, even if not shown, shut-off means may be provided, such as solenoid valves or the like, arranged along the inlet 11 and outlet 12 ducts capable of closing the respective water delivery and make-up ducts so as to prevent that during the recirculation operation of the water of the storage, it may be inadvertently circulated along the hydraulic system.

For clarity of description, the inlet and outlet sections of the pre-heater 4 and post-heater 5, as well as the inlet 11 and outlet 12 ducts whereon they may be installed, are defined in relation to the normal operation of the water heater 1, i.e. when replenishing "cold" water and when dispensing hot water during a withdrawal in progress.

Preferably, said pre-heater 4 and post-heater 5 are arranged externally to the tank 10 so as to allow the appropriate circulation of the storage water through said hydraulic duct 70 from the lower zone towards the upper zone of the tank 10, with the useful effect of guaranteeing the energy supply of said auxiliary heaters to the recirculation water and bringing the temperature of the storage water stored in the tank 10 to the desired temperature, substantially/preferably Tset.

According to different possible executive variants, said circulator 7 may be of the type:

- at fixed revolutions; in such case the flow rate of the recirculated water is substantially fixed;
- modulable or at variable revolutions, so as to regulate the flow rate of the recirculated water. In such case it is possible to obtain a modulable water supply towards said inlet section 120 of the said outlet duct 12, by calibrating/regulating the flow rate of recirculated water based on the temperature value $\vartheta o$, measured by the temperature sensor 64 and compared with the temperature values $\vartheta u$ and/or $\vartheta d$ and/or Tm.

Said water heater 1 may be further provided with one or more retaining means 8, preferably of the type that may be electrically or mechanically controlled, such as for example solenoid valves, motorised valves or the like.

According to a preferred variant, at least a controllable retaining means 8 is placed along the hydraulic duct 70 upstream of the circulator 7, substantially along the portion of hydraulic duct 70 that connects the inlet of the circulator 7 with:

- the inlet duct 11, for the variant with the only post-heater 5 (FIG. 5); or
- the inlet 40 of the pre-heater 4, for the variants with only pre-heater 4 (FIG. 1) or both with pre-heater 4 and post-heater 5 (FIG. 9).

A possible management method of the water heater 1 which may preferably be implemented via the control unit with which said water heater 1 is provided shall now be described, by way of a non-limiting example, said management method providing for different logics based on the fact that said water heater 1 comprises only the pre-heater 4, only the post-heater 5 or both.

Said control unit is therefore capable of controlling and commanding the different components of the water heater 1, such as for example the circulator 7, and/or both the main and auxiliary heating devices, and/or at least the retaining means 8.

Figure 4:
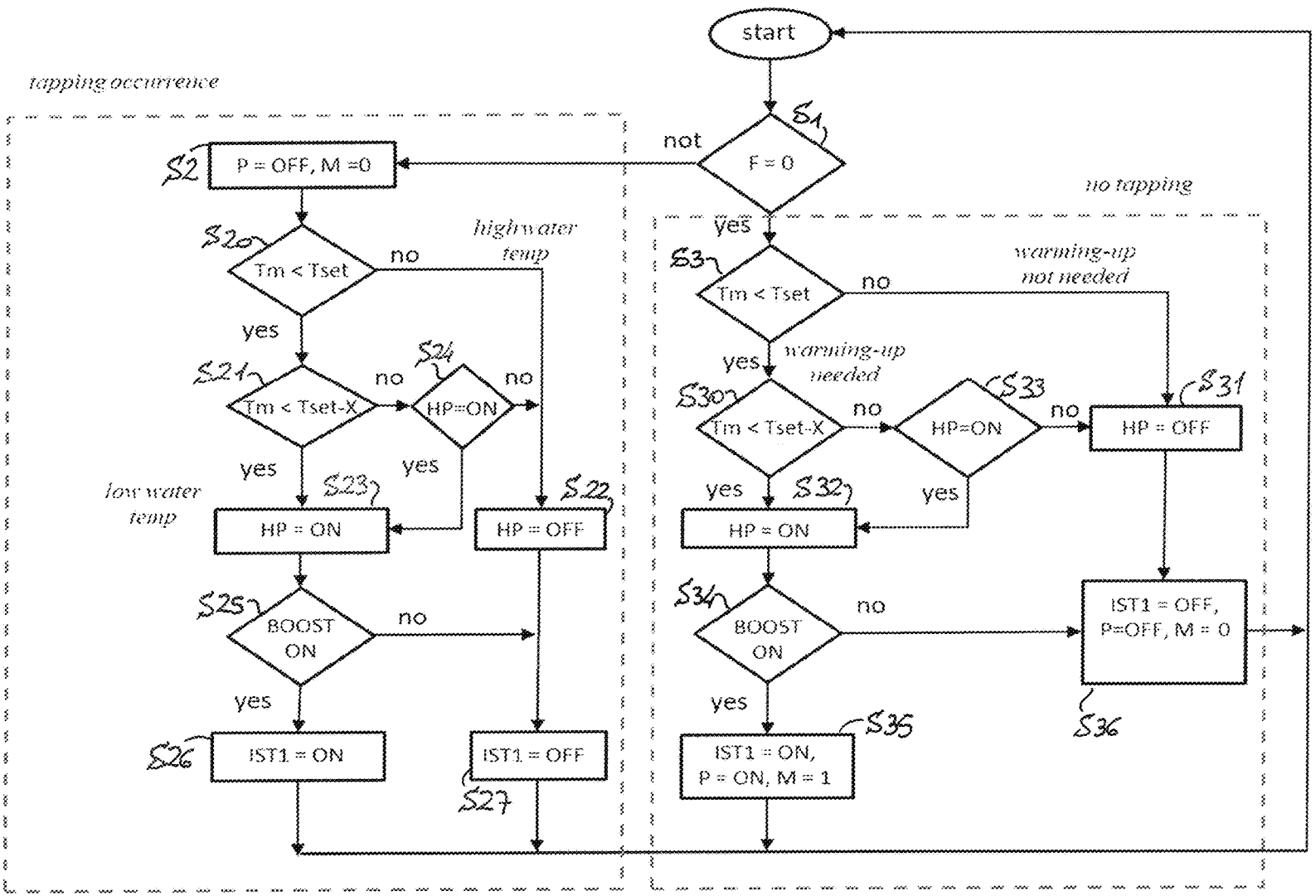
FIG. 4 shows a block diagram of a possible management method of the water heater of FIG. 1.
Figure 8:
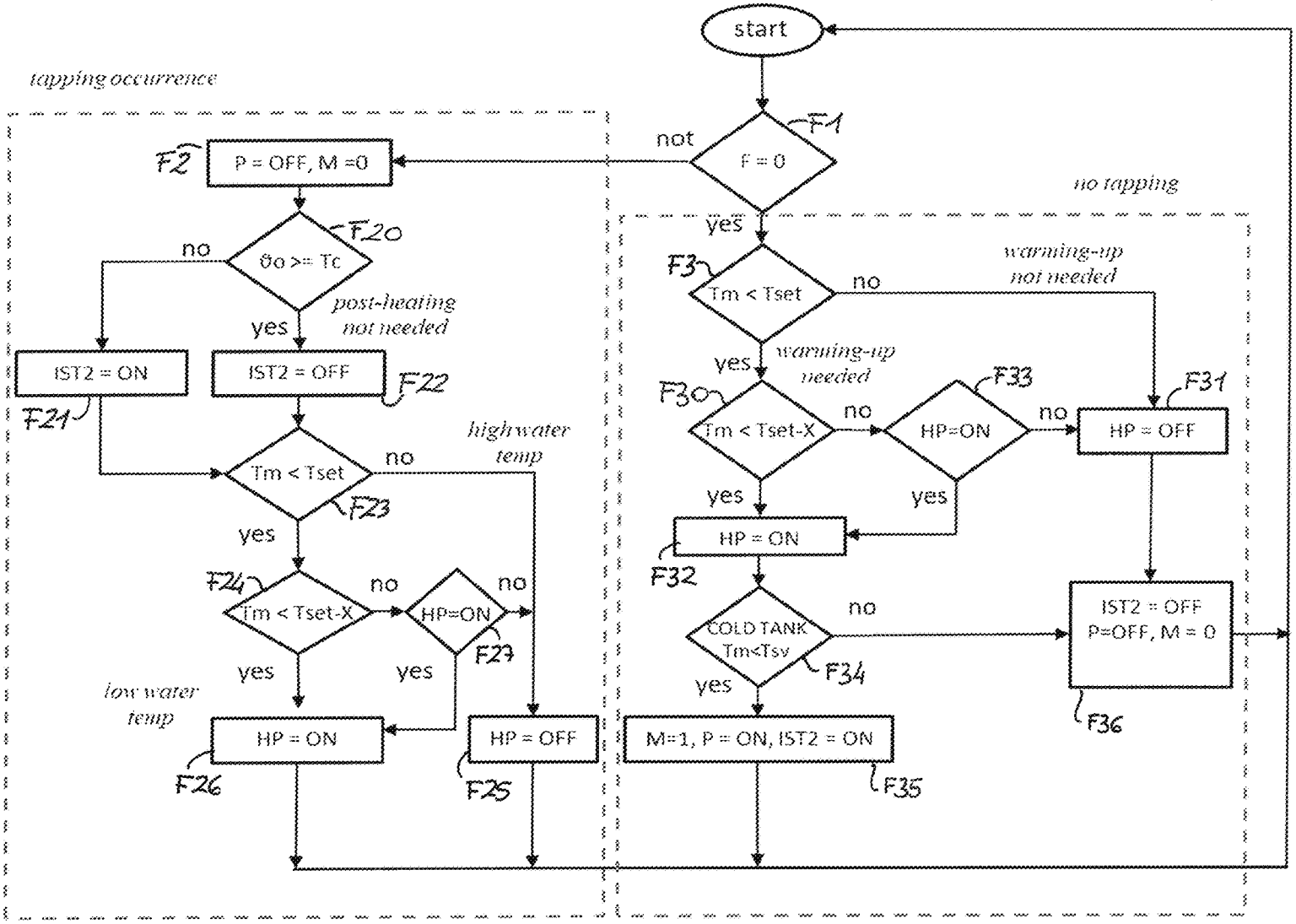
FIG. 8 shows a block diagram of a possible management method of the water heater of FIG. 5.
Figure 12:
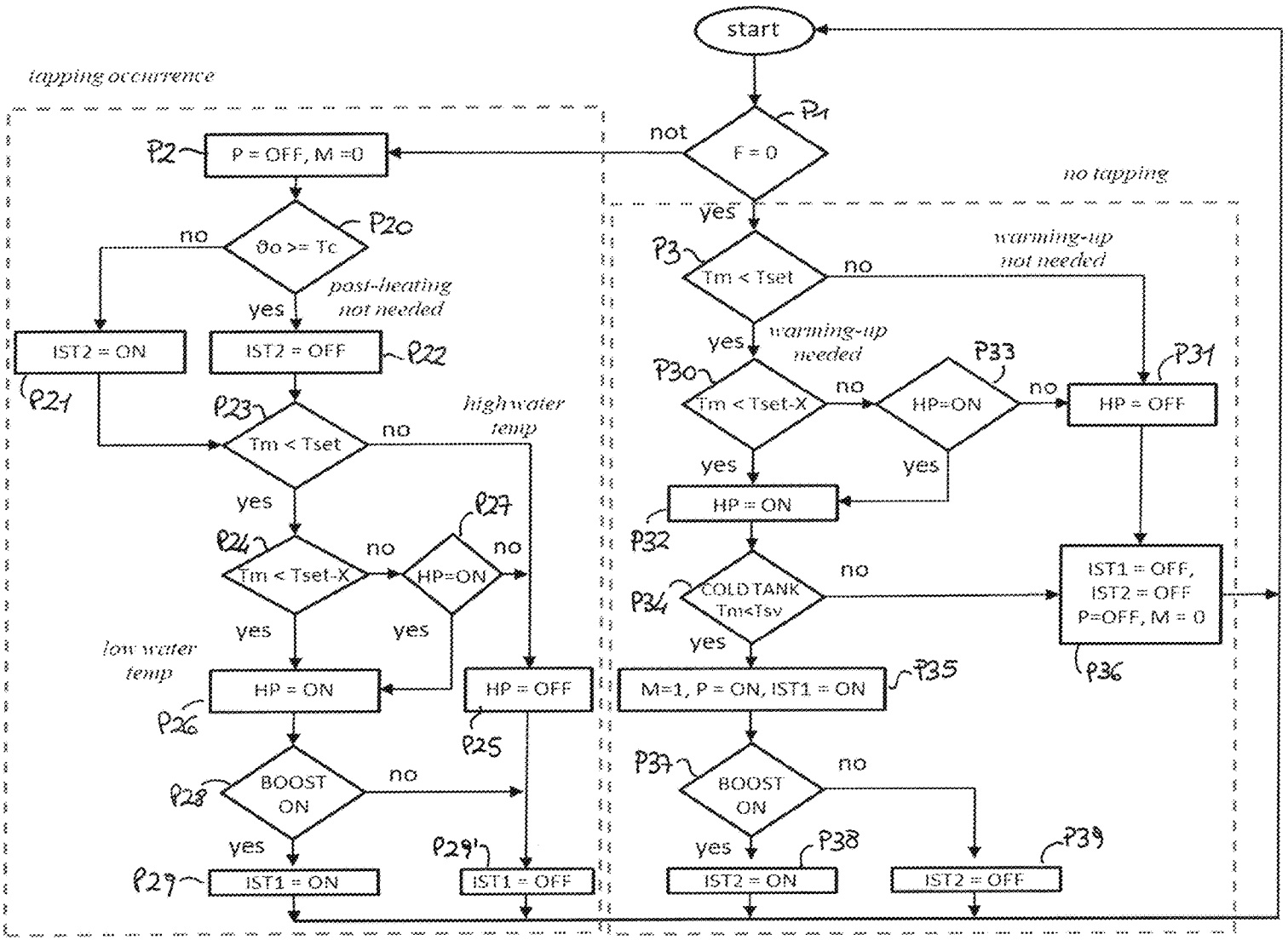
FIG. 12 shows a block diagram of a possible management method of the water heater of FIG. 9.

For a better clarity of description, in FIGS. 4, 8 and 12 some components of the water heater 1 have been indicated with acronyms, i.e. F: value detected by the flow sensor 60; HP: main heating device 2, IST1: pre-heater 4, IST2: post-heater 5, M: motorised valve 8, P: circulator 7 (such acronyms are also shown in FIGS. 1, 5 and 9).

Furthermore, still with reference to FIGS. 4, 8 and 12, it should be noted that in the block diagrams the rectangle shape represents an action, for example the activation of a heating device, while the diamond shape represents a control, for example a comparison among temperatures.

Said management method is aimed at controlling/coordinating different components of the water heater 1 such as, for example, at least the different heating devices of the water heater 1, both main and auxiliary, at least the circulator 7 and/or at least the retaining means 8, if provided, based on the functions to be implemented, whether standard/normal or additional.

The management method may consider different factors in order to implement such control/coordination, such as for example the presence/absence of a withdrawal, the number and/or type of said heating devices, and/or the set-point temperature Tset and/or the temperature Tc and/or the temperature of the storage water which may possibly be represented by one or more of the temperatures $\vartheta u$ and/or $\vartheta d$ and/or Tm.

Said management method is characterised in that it implements one or more supplementary heating functions, by one or more of said auxiliary devices, of the water introduced and/or withdrawn from the storage and or of the same storage, where the activation or not of one or more of said supplementary functions being able to depend on at least:

- the presence or not of a withdrawal; and/or
- the control of at least the storage water temperature, preferably representable by the average temperature Tm.

Generally, according to different possible executive variants, the non-activation or deactivation of at least one or more of said additional functions may depend on at least the absence or the end of a withdrawal.

Hereinafter, the term "no withdrawal", without any limiting intent, is to be referred to as both the absence of a withdrawal and the end thereof, these conditions corresponding to measurements of the flow sensor 60 substantially equal to zero.

Generally, said additional functions may at least comprise, for example, the BOOST function and/or the COLD TANK function or the like.

The first phase S1, F1, P1 of the method according to the present invention, common to all of the variants of said method illustrated herein, provides for checking, via the flow sensor 60, whether or not a hot water withdrawal is in progress or not and based on such condition, the variants of said method may implement two different possible operating/management logics, one of which is dedicated to the case of a withdrawal and the other to the case of no withdrawal.

With reference to FIG. 4, the management method of a water heater 1 provided with the only pre-heater 4 and which may be equipped with at least the BOOST function shall be described herein.

Case of Withdrawal in Progress ("Tapping Occurrence")

During a withdrawal ($F \neq 0$), said method provides, through the phase S2, for switching off or maintaining said circulator 7 switched off (P=OFF) and for switching and/or maintaining the motorised valve (8) in a closed position (M=0); the object is to close the hydraulic duct 70 so as to avoid that the make-up water may mix with the hot water supplied by the water heater 1, cooling it and creating uncomfortable conditions to the user.

In such conditions (F≠0; P=OFF; M=0), the management method provides for comparing the value of the average temperature Tm with the value of the set-point temperature Tset through the phase S20.

It should be noted that, in general, the average temperature Tm may vary, for example, by virtue of the quantity and the temperature of the make-up water.

In fact, the make-up water, generally having a temperature value lower than that of Tm, tends to lower the value of the average temperature Tm.

Following the comparison between Tm and Tset (phase S20):

if Tm is lower than Tset, the next phase S21 is provided;

if Tm is greater than Tset, the main heating device 2 remains switched off or in stand-by (HP=OFF), phase S22.

Phase S21 is provided and implemented if, as preferred, a hysteresis parameter X is subtracted from the temperature Tset in order to avoid frequent and subsequent re-ignitions of the main heating device 2.

Said phase S21 provides for comparing Tm with Tset−X and following said comparison:

if Tm is lower than Tset−X, the main heating device 2 is activated (HP=ON), so as to bring the temperature of the storage back to the desired and set temperature Tset, phase S23, if Tm is greater than Tset−X, phase S24 is provided.

The aim of the phase S24 is to check whether the main heating device 2 is switched on or not during the withdrawal.

In fact, the temperature at which the storage should be heated is Tset, and not Tset−X, therefore, during a withdrawal:

if the main heating device 2 is already in operation, then it should remain switched on and phase S23 is provided, while if the main heating device 2 is switched off or in stand-by, then it should remain switched off or in stand-by and phase S22 is provided.

If the water heater 1 is equipped with the BOOST function, the method, following the activation of the main heating device 2, checks whether the BOOST function is set and selected via the phase S25.

If the BOOST function is selected, phase S26 is provided, by activating the pre-heater 4 (IST1=ON), while if the BOOST function is disabled the pre-heater 4 remains switched off (IST1=OFF), phase S27.

It should be noted that the BOOST function, if selected/activated, is preferably implemented only if the main heating device 2 is active; otherwise such BOOST function is not performed, as the storage does not need heat (Tm>Tset−X and HP=OFF).

When the BOOST function is implemented (IST1=ON) the make-up water is heated, accelerating the heating of the storage and consequently reducing the time necessary to substantially bring the storage to Tset.

Essentially, the heat supplied by the main device 2 is added to the heat supplied by the pre-heater 4.

Case of No Withdrawal ("No Tapping")

In case of no withdrawals (F=0) or at the end of a withdrawal, said method provides for monitoring the value of the average temperature Tm and comparing it with Tset, phase S3; the aim is not to allow the water of the storage to cool too much.

In such case, in fact, the average temperature Tm may vary mainly due to heat losses or the like which may lead to a progressive decrease in the temperature Tm.

Following the comparison between Tm and Tset (phase S3):

if Tm is lower than Tset, the next phase S30 is provided, if Tm is greater than Tset, the main heating device 2 remains switched off or in stand-by (HP=OFF) as well as the pre-heater 4, phase S31.

Phase S30 is provided and implemented if, as preferred, a hysteresis parameter X is subtracted from the temperature Tset, in order to avoid frequent and subsequent re-ignitions of the main heating device 2.

Said phase S30 provides for comparing Tm with Tset−X and following said comparison:

if Tm is lower than Tset−X, at least the main heating device 2 is activated (HP=ON), phase S32, if Tm is greater than Tset−X, phase S33 is provided.

The aim of phase S33 is to check if the main heating device 2 is switched on or not.

In fact, the temperature at which the storage should be heated is Tset and not Tset−X, therefore in absence of a withdrawal:

if the main heating device 2 is already in operation, then it should remain switched on and phase S32 is provided, while if the main heating device 2 is switched off or in stand-by, then it should remain switched off or in stand-by and phase S31 is provided.

If the water heater 1 was equipped with the BOOST function, the method, following the activation of the main heating device 2, checks whether the BOOST function is set and selected, phase S34.

If the BOOST function is selected, opening the motorised valve 8 (M=1), operating the circulator 7 (P=ON), and activating the pre-heater 4 (IST1=ON) is provided, phase S35.

It should also be noted that during this phase, the main heating device 2 keeps being in operation.

In such way, water is withdrawn from the lower part of the tank 10, which, by virtue of the stratification is colder than the water of the top part of the same tank 10 (FIG. 3), it is heated and introduced in the top part of the tank 10 by using the outlet duct 12.

Such recirculated water, under the action of the circulator 7 and through the outlet section 110 of the inlet duct 11, crosses part of the inlet duct 11 and reaches and crosses the pre-heater 4, which provides for heating it, and it is then sent, through the connecting hydraulic duct 70 and the outlet duct 12, (which is that normally designed to the withdrawal/hot water supply), in the top part of the tank 10 outflowing from the inlet section 120 of the said same outlet duct 12.

Such recirculation of the storage water, allows such water to be heated via the pre-heater 4, by taking the temperature of the storage to the desired one more quickly, substantially Tset, compensating for the heat losses of the tank 10.

Essentially, the heat supplied by the pre-heater 4 adds to that supplied by the main device 2.

The energy content or the temperature of the storage or the temperature of the storage, substantially Tset, may be restored more quickly through the BOOST function.

If the BOOST function is disabled, closing and maintaining closed the motorised valve 8 (M=0), switching off or maintaining switched off the circulator 7 (P=OFF), and deactivating or keeping deactivated the pre-heater 4 (IST1=ON) is provided, phase S36.

With reference to FIG. 8, the management method of a water heater 1 provided with only the post-heater 5 and which may be equipped with at least the COLD TANK function shall be described herein.

Case of Withdrawal in Progress ("Tapping Occurrence")

During a withdrawal (F≠0), said method provides for, through the phase F2, switching off or maintaining switched off said circulator 7 (P=OFF) and switching and/or maintaining the motorised valve (8) in the closed position (M=0); the aim is to close the hydraulic duct 70 so as to avoid the make-up water to mix, downstream of the post-heater 5, with the hot water supplied by the water heater 1, cooling it and creating uncomfortable conditions for the user.

In such conditions (F≠0; P=OFF; M=0), the management method provides for checking the value of the temperature out 90, detected by the temperature sensor 64, and comparing it with the value of the comfort temperature Tc, which may be set by the manufacturer and/or installer and/or user, phase F20.

Following the comparison (F20):

- if the temperature out 90 is lower than the comfort temperature Tc, the post-heater 5 (IST2=ON) is activated so as to meet the set temperature Tc, phase F21,
- if the temperature out 90 is greater than or equal to the comfort one Tc, the post-heater 5 is not activated (IST2=OFF), phase F22.

The subsequent phase F23 provides for comparing the value of the average temperature Tm with the value of the set-point temperature Tset.

It should be noted that, in general, the average temperature Tm may vary, for example, by virtue of the quantity and the temperature of the make-up water.

Following the comparison between Tm and Tset (phase F23):

- if Tm is lower than Tset, the next phase F24 is provided;
- if Tm is greater than Tset, the main heating device 2 remains switched off or in stand-by (HP=OFF), phase F25.

Phase F24 is provided and implemented if, as preferred, a hysteresis parameter X is subtracted from the temperature Tset.

Said phase F24 provides for comparing Tm with Tset−X and following said comparison:

- if Tm is lower than Tset−X, the main heating device 2 is activated (HP=ON), so as to bring the temperature of the storage back to the desired and set temperature Tset, phase F26,
- if Tm is greater than Tset−X, phase F27 is provided.

The aim of the phase F27 is to check whether the main heating device 2 is switched on or not during the withdrawal.

In fact, the temperature at which the storage should be heated is Tset, and not Tset−X, therefore, during a withdrawal:

- if the main heating device 2 is already in operation, then it should remain switched on and phase F26 is provided, while
- if the main heating device 2 is switched off or in stand-by, then it should remain switched off or in stand-by and phase F25 is provided.

Case of No Withdrawal ("No Tapping")

In case of no withdrawals (F=0) or at the end of a withdrawal, said method provides for monitoring the value of the average temperature Tm and comparing it with Tset, phase F3; the aim is not to allow the storage water to cool too much, for example due to heat losses or the like which may lead to a progressive decrease in the temperature Tm.

Following the comparison between Tm and Tset (phase F3):

- if Tm is lower than Tset, the next phase F30 is provided,
- if Tm is greater than Tset, the main heating device 2 remains switched off or in stand-by (HP=OFF) as well as the pre-heater 4, phase F31.

Phase F30 is provided and implemented if, as preferred, a hysteresis parameter X is subtracted from the temperature Tset.

Said phase F30 provides for comparing Tm with Tset−X and following said comparison:

- if Tm is lower than Tset−X, at least the main heating device 2 is activated (HP=ON), phase F32,
- if Tm is greater than Tset−X, phase F33 is provided.

The aim of phase F33 is to check if the main heating device 2 is switched on or not.

In fact, the temperature at which the storage should be heated is Tset and not Tset−X, therefore in absence of a withdrawal:

- if the main heating device 2 is already in operation, then it should remain switched on and phase F32 is provided, while
- if the main heating device 2 is switched off or in stand-by, then it should remain switched off or in stand-by and phase F31 is provided.

The subsequent phase F34 provides for verifying whether the storage falls within the COLD TANK condition.

If the COLD TANK condition is detected, for example following a significant withdrawal (in terms of volume of water withdrawn) or even small, subsequent and close withdrawals or if a future withdrawal is provided through the use of SMART logics, opening the motorised valve 8 (M=1) is provided by operating the circulator 7 (P=ON), and activating the post-heater 5 (IST2=ON), phase F35.

It should also be noted that during this phase, the main heating device 2 keeps being in operation.

In such way, water is withdrawn from the lower part of the tank 10, which, by virtue of the stratification is colder than the water of the top part of the same tank 10 (FIG. 7), it is heated and introduced in the top part of the tank 10 by using the outlet duct 12.

Such recirculated water, under the action of the circulator 7 and through the outlet section 110 of the inlet duct 11, crosses part of the inlet duct 11, the hydraulic connection duct 70 and reaches and crosses the post-heater 5, which provides for heating it, and it is then sent, through the outlet duct 12, to the top part of the tank 10 outflowing from the inlet section 120 of the said outlet duct 12.

Such recirculation of the storage water allows, in absence of a withdrawal, heating such water through the post-heater 5 and maintaining the storage at a temperature substantially greater or equal to the threshold temperature Tsv, in order to be able to guarantee water at a temperature as closer to the comfort temperature Tc in the lesser possible time.

If the COLD TANK condition is not detected or lost, the motorised valve 8 remains or is closed (M=0), the circulator 7 deactivated (P=OFF) and the post-heater 5 (IST2=OFF) switched off or in stand-by, phase F36.

With reference to FIG. 12, the management method of a water heater 1 provided with both the pre-heater 4 and the post-heater 5 and which may be equipped with both the BOOST and COLD TANK function shall be described herein.

Case of Withdrawal in Progress ("Tapping Occurrence")

During a withdrawal (F≠0), said method provides, through phase P2, for switching off or maintaining switched off said circulator 7 (P=OFF) and switching and/or keeping the motorised valve 8 in a closed position (M=0); the aim is to close the hydraulic duct 70 so as to avoid the make-up water to mix, downstream of the post-heater 5, with the hot water supplied by the water heater 1, cooling it and creating uncomfortable conditions to the user.

In such conditions (F≠0; P=OFF; M=0), the management method provides for checking the value of the temperature out ϑo, detected by the temperature sensor 64, and comparing it with the value of the comfort temperature Tc, which may be set by the manufacturer and/or installer and/or user, phase P20.

Following the comparison (P20):

- if the temperature out ϑo is lower than the comfort one Tc, at least the post-heater 5 (IST2=ON) is activated so as to meet the set temperature Tc, phase P21,
- if the temperature out ϑo is greater than or equal to the comfort one Tc, the post-heater 5 is not activated (IST2-OFF), phase P22.

The subsequent phase P23 provides for comparing the value of the average temperature Tm with the value of the set-point temperature Tset.

It should be noted that, in general, the average temperature Tm may vary, for example, by virtue of the quantity and the temperature of the make-up water.

Following the comparison between Tm and Tset (P23):

- if Tm is lower than Tset, the next phase P24 is provided;
- if Tm is greater than Tset, the main heating device 2 remains switched off or in stand-by (HP=OFF), phase P25.

Phase P24 is provided and implemented if, as preferred, a hysteresis parameter X is subtracted from the temperature Tset.

Said phase P24 provides for comparing Tm with Tset−X and following said comparison:

- if Tm is lower than Tset−X, the main heating device 2 is activated (HP=ON), so as to bring the temperature of the storage back to the desired and set temperature Tset, phase P26;
- if Tm is greater than Tset−X, phase P27 is provided.

The aim of the phase P27 is to check whether the main heating device 2 is switched on or not during the withdrawal.

In fact, the temperature at which the storage should be heated is Tset, and not Tset−X, therefore, during a withdrawal:

- if the main heating device 2 is already in operation, then it should remain switched on and phase P26 is provided, while
- if the main heating device 2 is switched off or in stand-by, then it should remain switched off or in stand-by and phase P25 is provided.

If the water heater 1 was equipped with the BOOST function, the method, following the activation of the main heating device 2, checks whether the BOOST function is set and selected, phase P28.

If the BOOST function is selected, one of the auxiliary devices is activated, preferably the pre-heater 4 (IST1=ON), phase P29, while if the BOOST function is disabled none of the auxiliary devices is activated, and in the case of the example, the pre-heater 4 remains switched off or in stand-by (IST1=OFF), phase P29'.

When the BOOST function is implemented (IST1=ON) it allows the make-up water to be heated, accelerating the heating of the storage and, consequently, reducing the time necessary to bring the storage substantially to Tset.

Essentially, the heat supplied by the main device 2 is added to the heat supplied by the pre-heater 4.

It should be noted that the BOOST function, if selected/activated, is preferably implemented only if the main heating device 2 is active; otherwise such BOOST function is not performed, as the storage does not need heat (Tm>Tset−X and HP=OFF).

Case of No Withdrawal ("No Tapping")

In case of no withdrawals (F=0) or at the end of a withdrawal, said method provides for monitoring the value of the average temperature Tm and comparing it with Tset, phase P3; the aim is not to allow the storage water to cool too much, for example due to heat losses or the like which may lead to a progressive decrease in the temperature Tm.

Following the comparison between Tm and Tset (phase P3):

- if Tm is lower than Tset, the next phase P30 is provided,
- if Tm is greater than Tset, the main heating device 2 remains switched off or in stand-by (HP=OFF) as well as the pre-heater 4, phase P31.

Phase P30 is provided and implemented if, as preferred, a hysteresis parameter X is subtracted from the temperature Tset.

Said phase P30 provides for comparing Tm with Tset−X and following said comparison:

- if Tm is lower than Tset−X, at least the main heating device 2 is activated (HP=ON), phase P32,
- if Tm is greater than Tset−X, phase P33 is provided.

The aim of phase P33 is to check if the main heating device 2 is switched on or not.

In fact, the temperature at which the storage should be heated is Tset and not Tset−X, therefore in absence of a withdrawal:

- if the main heating device 2 is already in operation, then it should remain switched on, phase P32 is provided, while
- if the main heating device 2 is switched off or in stand-by, then it should remain switched off or in stand-by, phase P31 is provided.

The subsequent phase P34 provides for verifying whether the storage falls within the COLD TANK condition.

If the COLD TANK condition is detected, for example following a significant withdrawal (in terms of volume of water withdrawn) or even small, subsequent and close withdrawals or if a future withdrawal is provided through the use of SMART logics, opening the motorised valve 8 (M=1) is provided, by operating the circulator 7 (P=O), and preferably activating only one of the two auxiliary devices, phase P35.

Preferably, the pre-heater 4 (IST1=ON) is activated, while the post-heater 5 preferably remains switched off or in stand-by (IST2=OFF).

It should also be noted that during this phase, the main heating device 2 keeps being in operation.

In such way, water is withdrawn from the lower part of the tank 10, which, by virtue of the stratification is colder than the water of the top part of the same tank 10 (FIG. 3), it is heated and introduced in the top part of the tank 10 by using the outlet duct 12.

Such recirculated water, under the action of the circulator 7 and through the outlet section 110 of the inlet duct 11, crosses part of the inlet duct 11 and reaches and crosses the pre-heater 4, which provides for heating it, and it is then sent, through the post heater 5, which in this step/conditions is kept deactivated, and the outlet duct 12, in the top part of the tank 10 outflowing from the inlet section 120 of the said outlet duct 12.

Such recirculation of the storage water allows, in absence of a withdrawal, to heat such water through the pre-heater 4 and to maintain the storage at a temperature substantially greater or equal to the threshold temperature Tsv, so as to be able to guarantee water at a temperature as closer to the comfort temperature Tc in the lesser possible time.

Obviously, nothing prevents such heating to be obtained through the post-heater 5, as an alternative or in combination to the use of the pre-heater 4 illustrated above.

In case the COLD TANK condition is not detected or lost, the motorised valve 8 remains or is closed (M=0), the circulator 7 deactivated (P=OFF), and the pre-heater 4 (IST1=OFF) and the post-heater 5 (IST2-OFF) switched off or in stand-by, phase P36.

If the water heater 1 is also equipped with the BOOST function, the method, following the activation of the main heating device 2 and the detection of the COLD TANK condition with consequent activation of the pre-heater 4, checks whether the BOOST function is set and selected, phase P37.

If the BOOST function is selected, even the post-heater 5 (IST2-ON) is activated, phase P38, while if the BOOST function is disabled, the post-heater 5 remains switched off (IST2=OFF), phase P39.

The energy content or the storage temperature, substantially Tset, may be restored more quickly through the BOOST function and the possible ignition of the post-heater 5.

Generally, therefore, in order to implement the COLD TANK function, it is possible to use at least an auxiliary device, i.e. a between said pre-heater 4 and post-heater 5 for which it is possible to integrate power adjustment means that allow the energy supply of said auxiliary heaters to be managed in relation to the comparison between the energy contents of the storage water and of the recirculation water.

Similarly, it is possible to use at least an auxiliary device, preferably the auxiliary device not used in the COLD TANK function, in order to implement the BOOST function.

Essentially, with reference to the case of no withdrawal, said pre-heater 4 and post-heater 5 may each alternatively implement either the COLD TANK function or the BOOST function with respect to each other.

Generally, the water heater according to the present invention, thanks to the adoption of auxiliary heating devices, may install and use a smaller main heating device; this is further true in the case of the heat pumps.

In fact, lower power heat pumps have smaller heat exchange surfaces (evaporator/condenser) and the overall dimension of the same heat pump will be reduced.

On the other hand, it is known that the electric heaters provide, by their nature, for reduced and compact overall dimensions and if they are used as auxiliary heating devices, the overall dimension of the water heater 1 is smaller than the overall dimension of a water heater of the same power which uses only a heat pump as a heating source.

Furthermore, the adoption of instantaneous heating devices allows the volume of the storage to be reduced, because such devices are able to effectively compensate for deep and frequent withdrawals by the user.

It should be noted that the adoption of smaller storages allows smaller heat pumps to be installed, further contributing to eliminate the overall dimensions of the water heater according to the present invention.

Several variants of the invention described above are possible to the man skilled in the art, without departing from the novelty scopes of the inventive idea, as well as it is clear that in the practical embodiment of the invention the various components described above may be replaced with technically equivalent elements.

We claim:

1. A water heater apparatus comprising:

at least one water heater;

at least one storage tank adapted to store water;

at least one control and management unit adapted to check said at least one water heater;

at least one inlet duct connected to said at least one storage tank so as to allow water to be introduced into said at least one storage tank; and at least one outlet duct connected to said at least one storage tank so as to allow water from said at least one storage tank to be withdrawn therethrough, wherein said at least one water heater comprises at least one main heater and at least one auxiliary heater, said at least one auxiliary heater being installed on said at least one inlet duct so as to act as a pre-heater of the water passing therethrough or on said at least one outlet duct so as to act as a post-heater the water passing therethrough, wherein said at least one water heater has at least one circulator defined by a hydraulic connection duct for a recirculation of the water in said at least one storage tank, said at least one circulator adapted to recirculate the water between a lower part and a top part of said at least one storage tank by passing through said at least one auxiliary heater.

2. The water heater apparatus of claim 1, wherein said at least one water heater comprises another auxiliary heater installed in another of said at least one inlet duct and said at least one outlet duct such that said at least one heater simultaneously acts as the pre-heater and as the post-heater.

3. The water heater apparatus of claim 2, wherein said at least one circulator is adapted to circulate the water between the lower part of said at least one storage tank and the pre-heater and the top part of said at least one storage tank, the at least one circulator being in fluid communication with an inlet of the pre-heater and the at least one outlet duct.

4. The water heater apparatus of claim 2, wherein said at least one circulator is adapted to circulate the water between the lower part of said at least one storage tank and the pre-heater and the post-heater and the top part of said at least one storage tank, the at least one circulator being in fluid communication with both the inlet of the pre-heater and the outlet of the post-heater.

5. The water heater apparatus of claim 1, wherein the at least one circulator is adapted to recirculate the water between the lower part of said at least one storage tank and the post-heater and the top part of said at least one storage tank, the at least one circulator being in fluid communication with an outlet of the post-heater and said at least one inlet duct.

6. The water heater apparatus of claim 1, wherein the at least one circulator is a fixed revolution circulator.

7. The water heater apparatus of claim 1, wherein the at least one circulator is a modulable or variable revolution circulator.

8. The water heater apparatus of claim 1, further comprising:

at least one retainer that is that is electrically or mechanically controllable.

9. The water heater apparatus of claim 8, wherein said at least one retainer is positioned on the hydraulic connection duct upstream of the at least one circulator.

10. The water heater apparatus of claim 1, further comprising:

at least one first temperature sensor positioned adjacent to the top part of said at least one storage tank, said at least one first temperature sensor detecting a first temperature of the water in the top part of said at least one storage tank;

at least one second temperature sensor positioned adjacent to the lower part of said at least one storage tank, said at least one second temperature sensor detecting a second temperature of the water in the lower part of said at least one storage tank;

at least one third temperature sensor positioned at said at least one inlet duct, said at least one third temperature sensor detecting a third temperature at said at least one inlet duct;

at least one fourth temperature sensor positioned at said at least one outlet duct upstream of an inlet of the post-heater, said at least one fourth temperature sensor detecting a fourth temperature of the water at said at least one outlet duct;

at least one fifth temperature sensor positioned at said at least one outlet duct downstream of an outlet section of the post-heater so as to detect a fifth temperature at the at least one outlet duct; and at least one flow sensor cooperative with said at least one storage tank so as to detect a flow of water entering or exiting the at least one storage tank.

11. The water heater apparatus of claim 1, wherein said at least one main heater is a heat pump, said at least one auxiliary heater being an instantaneous heater.

12. The water heater apparatus of claim 1, wherein said at least one auxiliary heater has a power regulator.

13. The water heater apparatus of claim 1, wherein said at least one main heater or said at least one auxiliary heater is installed externally of said at least one storage tank.

14. A method of managing the water heater apparatus of claim 1 so as to check or coordinate different components of the water heater apparatus, the method comprising:

implementing at least one heating function of said at least one auxiliary heater directed to the water introduced into or exiting from said at least one storage tank, wherein an activation of the at least one heating function depends on at least one of a presence of a withdrawal of water or a control of the temperature of the water in said at least one storage tank.

15. The method of claim 14, wherein the at least one heating function comprises at least:

a BOOST function that allows for an additional heating, with respect to that provided by said at least one main heater of the inlet water or of the storage tank of said at least one heater by said at least one auxiliary heater; or a COLD TANK function that allows for an additional heating if a cold tank condition has occurred when the water temperature of in the at least one storage tank has dropped below a threshold value.

16. The method of claim 15, wherein said water heater apparatus has only the pre-heater and is equipped with at least the BOOST function, where in case of a withdrawal, following a verification phase of a withdrawal, the method provides for:

switching off or maintaining switched off said at least one circulator and switching or maintaining a retainer in a closed position;

comparing a value of an average temperature Tm with a value of the set-point temperature Tset, where:

if Tm is lower than Tset, a next phase is provided;

if Tm is greater than Tset, said at least one main heater remains switched off or in a stand-by condition;

subtracting a hysteresis parameter X from the set-point temperature Tset and comparing the set-point temperature Tset with the Tm, where:

if Tm is lower than Tset-X, said at least one main heater is activated;

if Tm is greater than Tset-X, checking whether said at least one main heater is switched on or not during the withdrawal, wherein:

if said at least one main heater is already in operation, the at least one main heater remains switched on;

if said at least one main heater is switched off or in stand-by, said at least one main heater remains switched off or in stand-by;

checking if the BOOST function is set or selected:

if the BOOST function is selected, the pre-heater is activated;

if the BOOST function is disabled, the pre-heater remains switched off.

17. The method of claim 15, wherein the water heater apparatus is provided with only the pre-heater and is equipped with at least the BOOST function, wherein upon absence of a withdrawal, following the verification phase of a withdrawal, the method comprises:

monitoring a value of an average temperature Tm and comparing the average temperature Tm with a value of the set-point temperature Tset where:

if Tm is lower than Tset, the next phase is provided;

if Tm is greater than Tset, said at least one main heater device remains switched off or in stand-by;

subtracting a hysteresis parameter X from the set-point temperature Tset and comparing the set-point temperature Tset with the Tm, wherein:

if Tm is lower than Tset-X, said at least one main heater is activated;

if Tm is greater than Tset-X, checking whether said at least one main heater is switched on or not is provided, wherein:

if said at least one main heater is already in operation, said at least one main heater remains switched on;

if said at least one main heater is switched off or in stand-by, said at least one main heater remains switched off or in stand-by;

checking if the BOOST function is set or selected:

if said BOOST function is selected, the pre-heater is activated;

if said BOOST function is disabled the pre-heater remains switched off.

18. The method of claim 15, wherein said water heater apparatus is provided with the only the post-heater and is equipped with at least a COLD TANK function, where in case of a withdrawal, following a verification phase of a withdrawal, said method comprises:

switching off or maintaining switched off said at least one circulator and switching or maintaining the retainer in a closed position;

checking a value of the temperature out $\vartheta o$ and comparing the temperature out with a value of a comfort temperature Tc, where:

if the temperature out ϑo is lower than the comfort temperature Tc, the post-heater is activated;

if the temperature out ϑo is greater than the comfort temperature Tc, the post-heater is not activated;

comparing a value of an average temperature Tm with a value of the set-point temperature Tset, where:

if Tm is lower than Tset, the next phase is provided;

if Tm is greater than Tset, said at least one main heater remains switched off or in stand-by;

subtracting a hysteresis parameter X from the set-point temperature Tset and comparing the set-point temperature Tset with the Tm, where:

if Tm is lower than Tset-X, said at least one main heater is activated;

if Tm is greater than Tset-X, checking whether said at least one main heater is switched on or not during the withdrawal, wherein:

if said at least one main heater is already in operation, said at least one main heater remains switched on;

if said at least one main heater is switched off or in stand-by, said at least one main heater remains switched off or in stand-by.

19. The method of claim 15, wherein said water heater apparatus is provided with the only the post-heater and is equipped with at least the COLD TANK function, wherein absence of a withdrawal, following the verification phase of a withdrawal, the method comprises:

monitoring a value of te average temperature Tm and comparing the average temperature Tm with the value of the set-point temperature Tset, where:

if Tm is lower than Tset, the next phase is provided;

if Tm is greater than Tset, said at least one main heater remains switched off or in stand-by;

subtracting a hysteresis parameter X from said set-point temperature Tset and comparing the set-point temperature Tset with the Tm, where:

if Tm is lower than Tset-X, said at least one main heater is activated;

if Tm is greater than Tset-X, checking whether said at least one main heater is switched on or not is provided, where:

if said at least one main heater is already in operation, it remains switched on;

if said at least one main heater is switched off or in stand-by, it remains switched off or in stand-by;

verifying whether the water in said at least one storage tank falls within said COLD TANK condition:

if said COLD TANK condition is detected, opening the retainer, by operating the at least one circulator and activating the post-heater;

if it is not detected or said COLD TANK condition is lost, the retainer remains or is closed, the at least one circulator is deactivated, the post-heater is switched off or in stand-by.

20. The method of claim 15, wherein said water heater apparatus is provided both with the pre-heater and the post-heater and is equipped both with the BOOST function and the COLD TANK function, where in absence of a withdrawal, following a verification phase of a withdrawal, said method comprises:

monitoring a value of an average temperature Tm and comparing it with a value of the set-point temperature Tset, where:

if Tm is lower than Tset, a next phase is provided;

if Tm is greater than Tset, said at least one main heater remains switched off or in stand-by;

subtracting a hysteresis parameter X from said set-point temperature Tset and comparing it with the Tm, where:

if Tm is lower than Tset-X, said at least one main heater is activated;

if Tm is greater than Tset-X, checking whether said at least one main heater is switched on or not, where:

if said at least one main heater is already in operation, it remains switched on;

if said at least one main heater is switched off or in stand-by, it remains switched off or in stand-by;

providing for verifying whether the water in said at least one storage tank falls within the COLD TANK condition:

if said COLD TANK condition is detected, opening the retainer operating the at least one circulator and activating one of the at least one auxiliary heater;

if the COLD TANK condition is not detected or is lost, the retainer remains or is closed, the at least one circulator is deactivated, the at least one auxiliary heater is switched off or in stand-by;

checking if the BOOST function is set or selected:

if the BOOST function is selected, the post-heater is activated;

if the BOOST function is disabled, the post-heater remains switched off.

21. The method of claim 14, wherein said water heater apparatus is provided both with the pre-heater and the post-heater and is equipped both with the BOOST and the COLD TANK function, where in case of a withdrawal, following the verification phase of a withdrawal, the method comprises:

switching off or maintaining switched off the at least one circulator and switching or maintaining retainer in a closed position;

checking a value of a temperature out ϑo and comparing it with a value of a comfort temperature Tc, wherein:

if the temperature out ϑo is lower than the comfort temperature Tc, at least the post-heater is activated;

if the temperature out ϑo is greater than then the comfort temperature Tc, the post-heater is not activated;

comparing a value of an average temperature Tm with a value of the set-point temperature Tset, where:

if Tm is lower than Tset, a next phase is provided;

if Tm is greater than Tset, said at least one main heater remains switched off or in stand-by;

subtracting a hysteresis parameter X from the set-point temperature Tset and comparing it with said Tm, where:

if Tm is lower than Tset-X, said at least one main heater is activated;

if Tm is greater than Tset-X, checking whether said at least one main heater is switched on or not during the withdrawal, where:

if said at least one main heater is already in operation, it remains switched on;

if said at least one main heater is switched off or in stand-by, it remains switched off or in stand-by;

checking if the BOOST function is set or selected:

if the BOOST function is selected, one of said at least one auxiliary heater is activated;

if the BOOST function is disabled none of said at least one auxiliary heater is activated.

* * * * *